United States Patent [19]

Chagnon et al.

[11] 4,123,629

[45] Oct. 31, 1978

[54] CONNECTOR FOR TESTING AN ELECTRIC INSTALLATION

[75] Inventors: Maurice Chagnon, Villeurbanne; Michel Lemery, Ste Foy les Lyon, both of France

[73] Assignee: Delle-Alsthom S.A., Villeurbanne, France

[21] Appl. No.: 772,202

[22] Filed: Feb. 25, 1977

[30] Foreign Application Priority Data

Feb. 26, 1975 [FR] France ..... 76 05368

[51] Int. Cl.[2] ..... H01R 13/70; H01R 33/54

[52] U.S. Cl. ..... 200/51 R; 200/51.02

[58] Field of Search ..... 200/51 R, 51.02, 51.03, 200/51.09, 51.12, 51.04

[56] References Cited

U.S. PATENT DOCUMENTS

| | | | |
|---|---|---|---|
| 2,710,384 | 6/1955 | Dupre et al. | 200/51 R |
| 2,904,771 | 9/1959 | Burtt et al. | 200/51 R |
| 3,509,297 | 4/1970 | King | 200/51 R |
| 3,598,935 | 8/1971 | Nava et al. | 200/51.02 |
| 4,053,724 | 10/1977 | Llona | 200/51 R |

*Primary Examiner*—George F. Mautz

*Attorney, Agent, or Firm*—Sughrue, Rothwell, Mion, Zinn and Macpeak

[57] ABSTRACT

A connector for testing an electric installation by means of a mobile test connector half which is applied to a fixed test connector half, wherein the mobile half carries pins and push fingers and the fixed half carries sockets and mobile bridge contacts and wherein different distances between co-operating elements of the two halves enable switching operations to be graduated during mating. The invention applies in particular to protection installations.

4 Claims, 12 Drawing Figures

CONNECTOR FOR TESTING AN ELECTRIC INSTALLATION

FIELD OF THE INVENTION

The invention relates to a connector for connecting the elements of an electric installation to a test device, in particular in the case of the equipment of a protective installation, without having to remove the elements from the installation.

BACKGROUND OF THE INVENTION

When the proper operation of an electric installation e.g. a protective installation is to be checked, it is necessary to carry out a number of operations in a well-determined order. An example of a protective device is that which comprises:

A current transformer supplying an image of the line current of the protected devices, a device for measuring this image current and a trigger circuit operating if the measurement of the image current exceeds a threshold. It is necessary, in order to check the trigger circuit to:

(a) Inhibit the trigger circuit;

(b) Short-circuit the current transformer;

(c) Open the current measuring circuit;

(d) Connect the trigger and current measuring circuits to a test equipment.

These various phases of the checking operation must be carried out successively.

Devices have already been proposed which comprise a blade contact box which is connected to the installation to be checked and in which test plugs designed to break some contacts and to establish others for test purpose can be fitted.

But this type of contact is fragile and can become dirty and hence lead to faulty operation.

One aim of the invention is to produce a device enabling the testing of all types of protection without disturbing the operation of the installation. Another aim of the invention is to produce a device which is equipped with contact parts having high specific pressures, which are insensitive to foreign bodies which may enter the test device; they ensure excellent operation of the test device as well as avoiding any disturbance in the installation to be checked itself.

SUMMARY OF THE INVENTION

The invention provides a connector for connecting a protective device of an electric installation during operation to a test device without removing it. Said connector comprises a first half connected to the electric installation and a second half, which is portable, connected to a test device. The two halves carry an assembly of pairs of co-operating elements, one element of each pair being installed on one of the halves, the other element on the other of the halves. The one element emerging by a height from a mating surface of its half, the other element being inside its half at a depth from a mating surface of its half. It is possible to bring the second half into contact with the first half, bringing said mating surfaces against each other; a position in which switching operations are effected by the pairs of co-operating elements to enable a test. These pairs of co-operating elements are of two types: a first type in which the two elements are contact parts constituted, the one by a socket, the other by a pin and a second type in which one of the elements is a bridge member disposed, in the first half, on the terminals of a normally-closed bridge contact and the other of the elements is a protruding finger installed in the second half and wherein the difference between said height and said depth of the elements of a pair is not the same for all the pairs of co-operating elements and produces time shifts between the switching operations effected by bringing said mating surfaces against each other.

Preferably, all the sockets are carried by the first half and all the pins are installed on the second half. Further, all the protruding fingers have the same height and advantageously all the sockets are disposed at the same depth.

In particular, the invention provides a device wherein the co-operating elements of the second half form a stack of identical stages each of which is disposed perpendicularly to the stack and comprises the succession of a short pin, a protruding finger, a first long pin and a second long pin, these two pins being interconnected and wherein the co-operating elements of the first half (sockets and bridge members) are disposed in rows corresponding to the stages of the second half.

In one of the rows of the first half, the sockets of one row, co-operating with a short pin and a first long pin of the second half can in particular be connected to the terminals of the bridge contact of the same row; the row can be of two types: the deep type and the shallow type, the deep type being able to form groups of successive rows in each of which the sockets co-operating with a second long pin of the second half are interconnected, so as to enable short-circuiting of the sockets co-operating with a first long pin, through the long pins of the second half.

In the application of the test connected to a protective installation, the bridge contacts of the rows having deep bridge members are installed between a current supply source and the relay system which it supplies, while the bridge contacts of the rows having shallow bridge members are installed in the triggering circuit.

The second connector half is constituted so as to facilitate the gripping thereof, e.g. it is in the form of a handle for carrying, according to requirements, against various first connector halves, only one second half being used for checking the operation of the elements of several installations, whose connections with their first connector half are established as a function of the constitution of the elements to be checked.

The invention further provides means rendering it impossible to apply said faces of the first and second connector halves against each other by simple pushing of the second half against the first half, the halves being brought closer together or further apart by a nut and bolt system. Thus excessive manipulation speed and ensuing errors which could arise are avoided. Further, this nut and bolt system advantageously has non-return operation, i.e. the slope of the thread is sufficiently gentle for it to be impossible to tighten or untighten the connector under the effect of forces tending to move the two halves towards or away from each other.

Embodiments of the invention are described by way of example with reference to the accompanying drawings:

DESCRIPTION OF PREFERRED EMBODIMENTS

Figure 1:
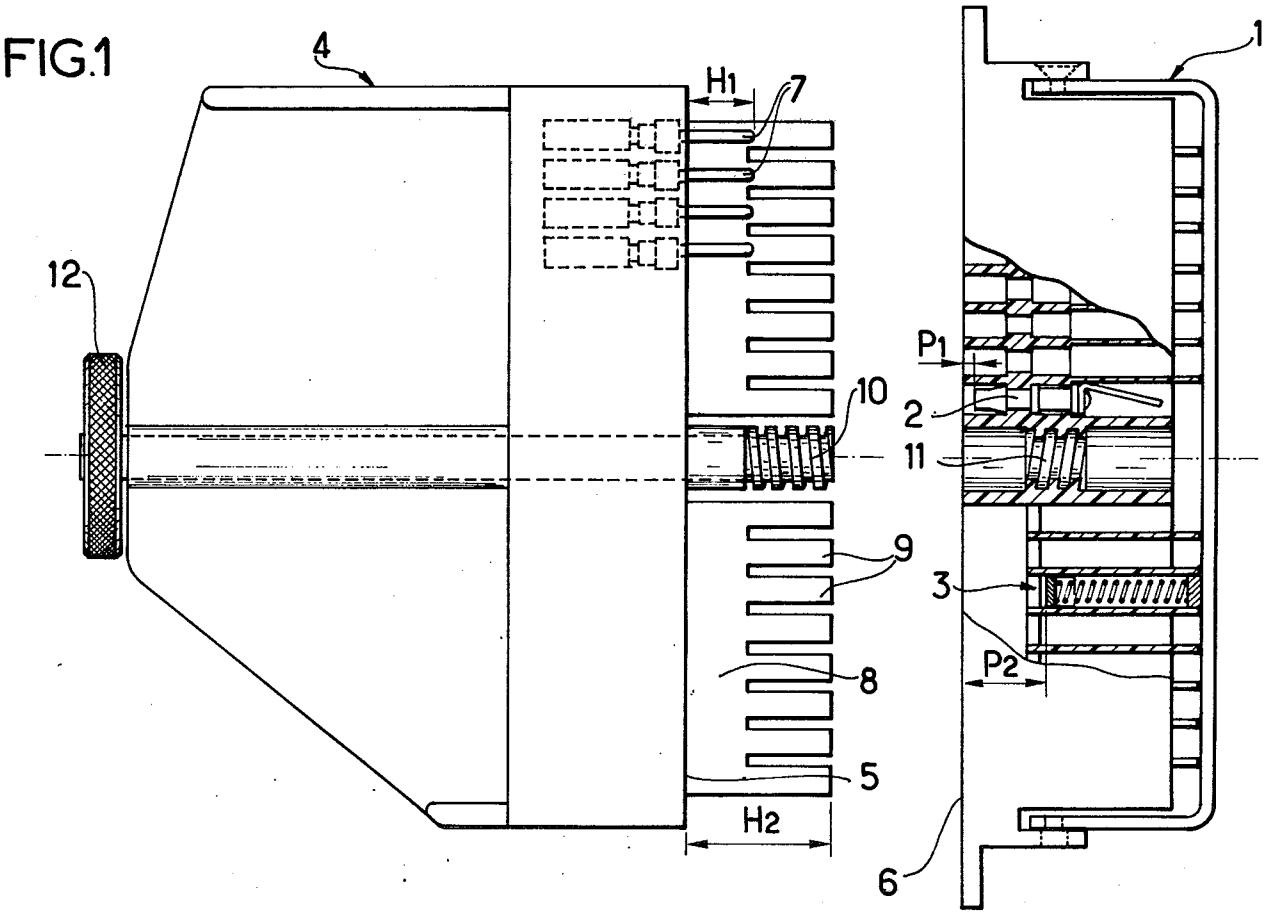
FIG. 1 is an elevation in partial section showing two halves of a test connector.

FIG. 1 shows a test connector with its two halves brought close together but not yet touching each other. On the right of the figure, a first connector half 1 (which forms a part of a plug-in module of an assembly of plug-in modules of an installation which is not shown) is shown with its top part sectioned along a column of sockets 2 (only one of which has been shown) and with its bottom part, sectioned along a column of bridge contacts 3 (only one of which has been shown). The connections of these elements with the remainder of the installation have not been shown.

On the left of the figure, a second connector half 4 which can be in the form of a moulded handle is connected by connections which are not shown to various items of test equipment which have not been shown. This half has three columns of pins (e.g. column 7) projecting from a face 5 which is applied to a face 6 of the first half 1. The second connector half 4 also has a column 8 of push fingers 9 which can be formed by moulding simultaneously with the handle itself.

A system comprising a bolt 10 on the plug half 4 and a nut 11 on the receptacle half 1 makes it possible to finish bringing the halves 1 and 4 together or to separate them by turning a knob 12 integral with the bolt 10. When the surfaces 5 and 6 are against each other, the fingers 9 have opened the bridge contacts by pushing against their bridging members and the pins 7 are in the sockets 2 with which they co-operate, a position in which all the necessary switching operations for the tests are effected.

In FIG. 1, all the sockets 2 are at the same depth P1 behind the surface 6 while the pins 7 do not all have the same length, i.e. do not project the same height H1 from the surface 5. In contrast, the fingers 9 all have the same length, i.e. all protrude to the same height H2 from the surface 5 while the bridge members of the bridge contacts 3 can be at various depths P2 behind the surface 6 which are not the same for all the bridge contacts.

Figures 2, 3, 4, 5, 6:
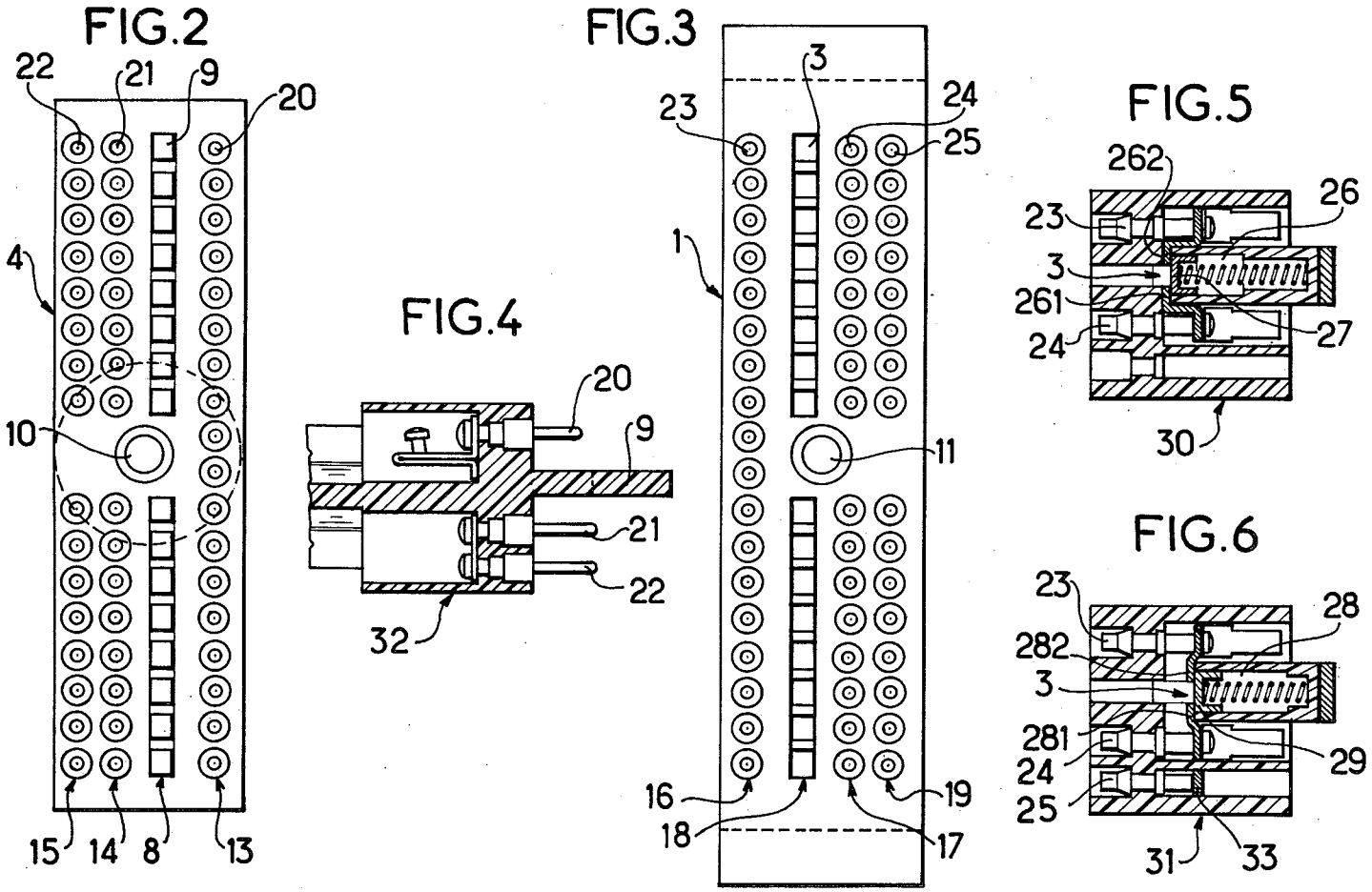
FIG. 2 is an end view of the plug or male half of the connector, i.e. the half shown on the left of FIG. 1.
FIG. 3 is an end view of the receptacle or female half of the connector, i.e. the half shown on the right of FIG. 1.
FIG. 4 is a partial horizontal cross-section of a stage of the plug.
FIGS. 5 and 6 are horizontal cross-sections of the receptacle showing different varieties of row.

It will be seen in FIGS. 2 and 3 that connector halves 1 and 4 comprise four columns of elements: two columns of pins 13 and 14 placed on either side of the column of fingers 8 and another column of pins 15, for the plug half 4; two columns of sockets 16, 17 placed on either side of a column of bridge contacts 18 and another column of pins 19 for the receptacle half 1.

But from a functional point of view, the elements must be considered as forming a vertical stack of horizontal stages in the plug 4 and a vertical stack of horizontal rows in the receptacle 1.

In FIG. 4, it is seen that each plug stage is formed by a short pin 20 (column 13), a finger 9, a first long pin 21 and a second long pin 22, these two long pins being electrically interconnected.

A row of the receptacle half 1 can comprise four co-operating elements, although some rows need not include all of the elements. These elements are: a socket 23 intended to co-operate with a short pin 20, a socket 24 intended to co-operate with a first long pin 21, a socket 25 intended to co-operate with a second long pin 22 and a bridge contact whose bridge member is resiliently biased to be normally applied against the terminals of the bridge contact and which is moved away therefrom by the push-finger 9 which it engages when the plug 4 is fitted in the receptacle 1. The two terminals of the bridge contact are electrically connected respectively to the socket 23, and to the socket 24.

FIGS. 5 and 6 show two such rows. These rows differ in the depths at which are located the bridge members 27 and 29 of their respective bridge contacts 26 and 28. The bridge member 27 of FIG. 5 is nearer to the front surface 6 of the receptacle 1 and consequently has generally S-shaped contacts 261 and 262 while the bridge member 29 of FIG. 6 is further from the surface 6 and has generally flatter contacts 281 and 282. The type of row in FIG. 5 will be designated by the reference numeral 30 and the type of row in FIG. 6 will be designated by the reference numeral 31, while a stage of the plug will be designated by the reference numeral 32.

Figure 7A:
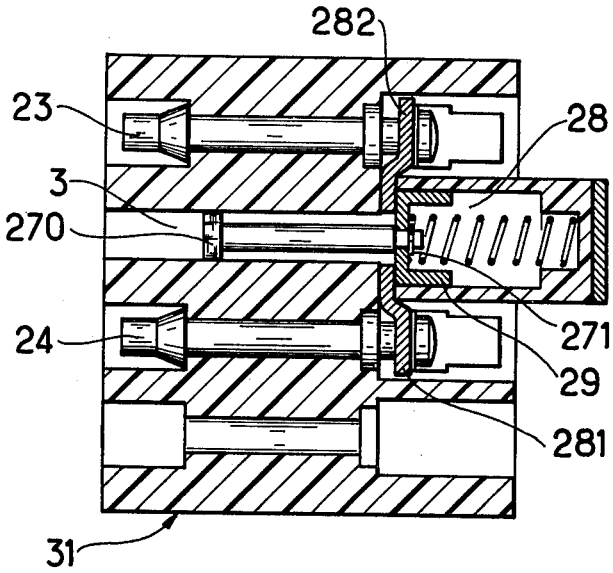
FIGS. 7*a* and 7*b* are variants of FIGS. 5 and 6.

FIG. 7*a* shows another embodiment of a row of sockets of the receptacle. The elements common to this figure and to FIG. 5 have been designated by the same reference numerals. The embodiment of FIG. 7*a* differs from the one in FIG. 5 in that the bridge member 27 is integral with an insulating push rod 270 fixed by a circlip 271.

Figure 7B:
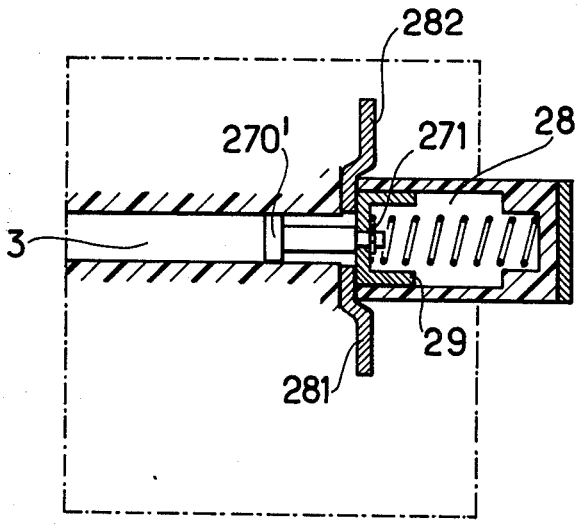

The push rod can have two lengths: a long length and a short length. The long length has been shown in FIG. 7*a* (270), and the short length (270') has been shown in the partial view in FIG. 7*b*.

This embodiment makes it possible to fit the receptacle 1 with sockets all placed at the same depth in relation to the surface 6, if so desired.

The action of the finger 9 on the push rod 270 having a longer length will be equivalent to the action of this push rod on the shallower bridge members 27 of FIG. 5.

The action of the finger 9 on the push rods 270' having a short length will be equivalent to the action of this push rod on the deeper bridge members 29 of FIG. 6.

Figure 8:
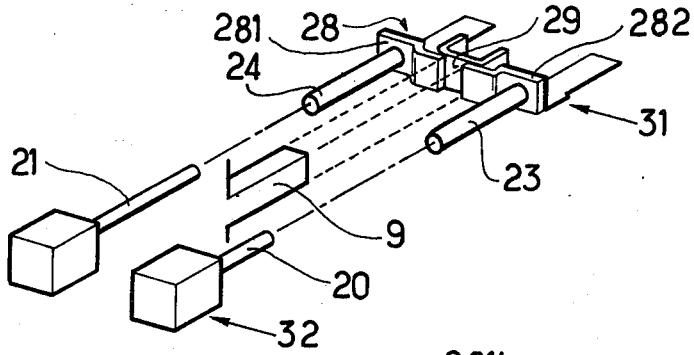
FIG. 8 is a schematic perspective view of the co-operating elements of a row of a receptacle and of a stage of a plug.

FIG. 8 shows that when a stage 32 enters a deep bridge row 31, the first long pin 21 comes into contact with the socket 24 before the finger 9 pushes back the bridge member 29 and opens the contact 28 and that finally, the short pin 20 comes in contact with the socket 23.

The terminals 281 of a group of several consecutive deep bridge rows 31 can be short-circuited by the pins 21 and 22 entering respectively into the sockets 24 and 25. For that purpose, the sockets 25 of the rows of the group are connected together by a vertical strap (see FIG. 9).

Figure 9:
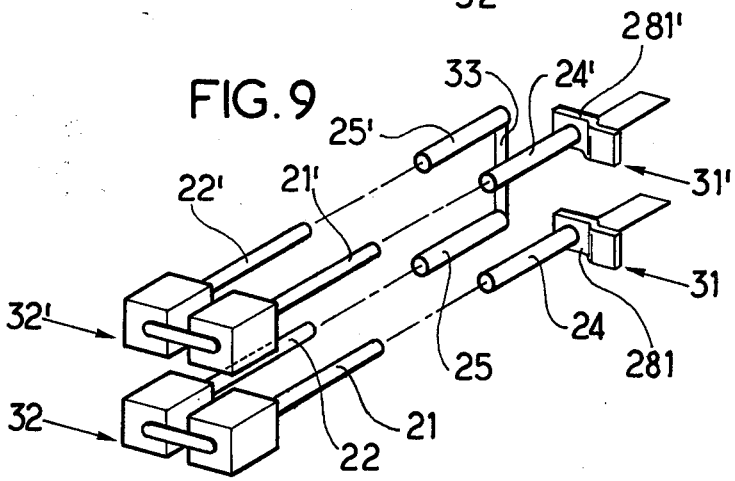
FIG. 9 is a schematic perspective view of the co-operating elements of two rows of a receptacle and of two stages of a plug enabling a short-circuit to be established.

FIG. 9 shows this embodiment in the case of a group of two rows 31, 31'. The sockets 25, 25' of the rows in question are electrically interconnected by a connection 33 so that the pins 21, 21' and 22, 22' of the stages in question 32, 32' interconnect the sockets 24, 24' previously to the opening of the contacts 28, 28'.

Besides the connector halves 1 and 4, the device can also include a cover fitted with short-circuit elements to ensure the protection of the receptacle 1 against accidental operation and to ensure the continuity of its electric circuits.

The fingers can be brought together to form a single plate, the receptacle 1 then having its push rods in a groove for receiving the plate.

By way of example, a connector may have the following characteristics:

16 rows of contacts per half.

Receptacle 1: on each row bridge members with push rods 2 or 7 mm from the front surface.

Plug 4: on each stage two pins having a length of 14 mm from the front surface, one pin having a length of 9 mm from the front surface, one finger having a length of 16 mm from the front surface.

Figure 10:
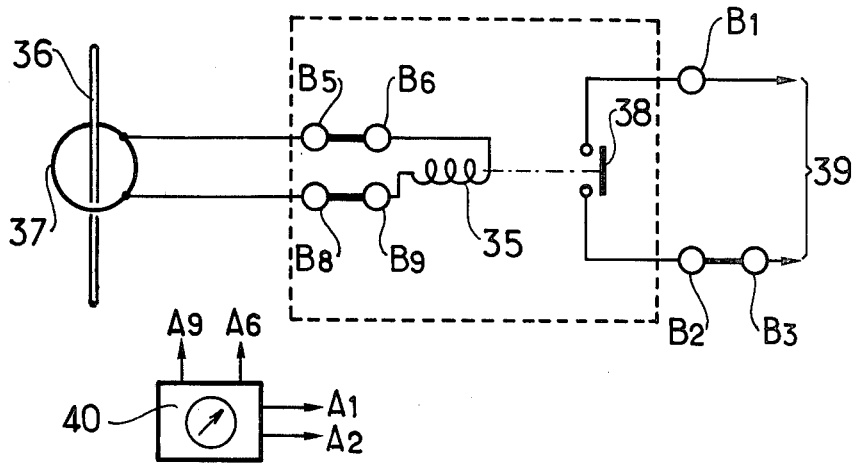
FIG. 10 is a schematic view of a relay showing a mode of application of the invention.

It will be shown how the device can be used to test the operation of a relay such as the one in FIG. 10. This relay, shown in the rectangle formed by dashed lines in FIG. 10, comprises a winding 35 fed across a current transformer 37 by the circuit 36 to be protected. When the operation threshold of the relay is reached, a normally open contact 38 closes a trigger circuit 39 such as a circuit-breaker.

To test the relay, it is necessary to: Inject current in its winding 35; but to carry out this test, it is necessary previously to have:

Disconnected the trigger circuit 39;

Short-circuited the current transformer 37;

Opened the circuit of the winding 35.

Only then is it possible to switch on a test circuit such as the one schematically illustrated by the rectangle 40 and comprising an auxiliary current source and measuring equipment.

Figure 11:
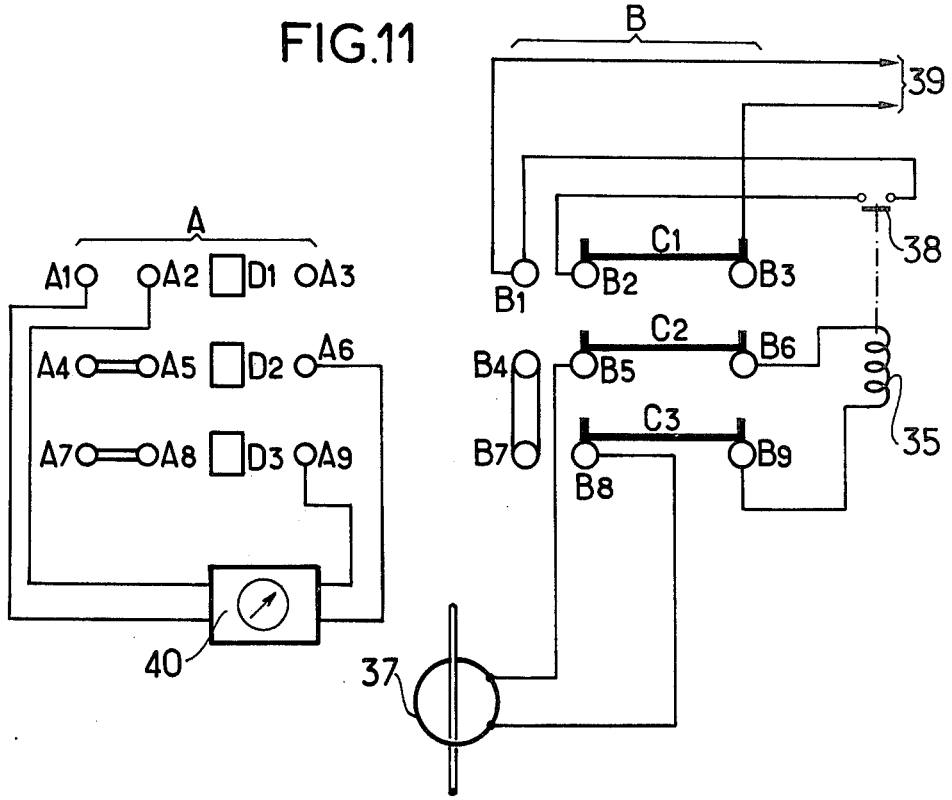
FIG. 11 is a schematic view showing the application of the invention to the relay of FIG. 10.

The connector of the invention makes it possible to produce this succession of operations with only one plugging in operation. To do this, it is necessary to effect previously the following connections:

Three rows of contacts are used as shown in FIG. 11.

The pins of a plug 4 shown under the bracket A are connected to the test equipment 40 and the sockets of a receptacle 1 shown under the bracket B are connected to the relay 10 whose operation is to be tested.

The pins A1, A2, A4, A5, A7 and A8 are long and are connected electrically in pairs as shown in FIG. 11.

The pins A3, A6 and A9 are short.

The sockets B2 to B9 co-operate respectively with the pins A2 to A9, and the sockets B4 and B7 are electrically interconnected.

A bridge member C1 is shallow (or is fitted with a long push rod) and is disposed across the sockets B2 and B3 while bridge members C2 and C3 are at a greater depth (or are fitted with short push rods) and are disposed respectively across the sockets B5 – B6 and B8 – B9.

The connection previous to the test is as follows:

Points B2 and B3 of the connector are inserted in series in the trigger circuit 39;

The poles of the secondary winding of the current transformer 37 are connected to B5 and B8;

The winding 35 of the relay 10 is connected across B6 and B9;

The test circuit 40 is connected at A6 and A9.

Operation is as follows:

When the connector halves 1 and 4 are brought together, the finger D1 operates first, moving the bridge member C1 away from the sockets B2 and B3, this causing the disconnection of the trigger circuit; Then, the long contacts A2, A4, A5, A7, A8 enter the corresponding sockets this electrically connecting the sockets B5, B4, B7 and B8, causing the short-circuiting of the current transformer 37;

Then, the fingers D2 and D3 operate the bridge members C2 and C3, this opening the circuit of the winding 35;

Lastly, the short pins A3, A6 and A9 enter their corresponding sockets, this making it possible to connect the winding 35 and the contact 38 to the test circuit.

The example which has just been given has no limiting character. The man in the art could make the connections of the connector for testing other types of relays.

For example, in the case where a relay equipped with a current transformer but having a trigger contact which opens to operate.

Likewise, it would be possible to use the connector to test a relay equipped with a voltage transformer.

What is claimed is:

1. A connector for connecting a protective device of an electric installation under operation to a test device without removing said protective device from said installation, said connector comprising: a first half connected to said electric installation and a second, portable half connected to said test device, said second half comprising a plurality of identical rows of elements, each second half row comprising two electrically connected long pins, a short pin and a finger made of insulating material, said first half comprising a plurality of rows, said first half rows being of a first and second kind, said first kind of first half rows comprising two sockets receiving respectively a short pin and a long pin of a second half row, said two sockets being electrically bridged by a first bridge member, resilient means normally pressing said first bridge member onto said two sockets, said first bridge member being removed from said two sockets by said finger when said first half is connected to said second half, said second kind of first half rows comprising two sockets receiving respectively a short pin and a long pin of a row of said second half, said second kind of first half row two sockets being electrically bridged by a second bridge member, resilient means normally pressing said second bridge member onto said second kind of first half row two sockets, said second bridge member being at a different position with respect to said finger than said first bridge member of said first kind of rows, said second bridge member being removed from said second kind of first half row two sockets by a finger when said first half is connected to said second half, said second kind of rows comprising a third socket receiving a long pin of said second half, and means to in final sequence, electrically connect said third socket to a corresponding third socket of an adjacent row.

2. The connector according to claim 1, wherein said fingers are joined together in a single plate.

3. The connector according to claim 1, wherein said first and second halves are fitted with a nut and a non-return operation bolt.

4. The connector according to claim 2, wherein said first and second halves are fitted with a nut and a non-return operation bolt.

* * * * *